US005726428A

United States Patent [19]

Christensen

[11] Patent Number: 5,726,428

[45] Date of Patent: Mar. 10, 1998

[54] MICROWAVE OVEN SHELF HAVING MULTIPLE FOOD SUPPORTING SURFACE

[76] Inventor: Michael D. Christensen, 454 Waring Way, Gahanna, Ohio 43230

[21] Appl. No.: 403,211

[22] Filed: Mar. 13, 1995

[51] Int. Cl.[6] ..... H05B 6/80

[52] U.S. Cl. ..... 219/754; 219/755; 219/763; 219/732; 99/DIG. 14; 126/338

[58] Field of Search ..... 219/763, 754, 219/755, 732; 99/443 R, DIG. 14; 126/338, 337 R, 332; 108/59, 91

[56] References Cited

U.S. PATENT DOCUMENTS

| | | | |
|---|---|---|---|
| 3,847,461 | 11/1974 | Gilmore | 219/763 |
| 4,249,464 | 2/1981 | Hansen | 99/450 |
| 4,258,630 | 3/1981 | Jorgensen et al. | 108/20 |
| 4,337,384 | 6/1982 | Tanaka et al. | 219/754 |
| 4,434,343 | 2/1984 | Bowen et al. | 219/755 |
| 4,456,805 | 6/1984 | Jorgensen et al. | 219/10.55 |
| 4,504,715 | 3/1985 | Jorgensen et al. | 219/10.55 |
| 4,523,070 | 6/1985 | Jorgensen et al. | 219/10.55 |
| 4,539,455 | 9/1985 | Colato et al. | 219/10.55 |
| 4,593,171 | 6/1986 | Colato | 219/10.55 |
| 4,625,087 | 11/1986 | Jorgensen et al. | 219/10.55 |
| 4,691,088 | 9/1987 | Eke | 219/754 |
| 4,713,513 | 12/1987 | Colato | 219/10.55 |
| 4,748,308 | 5/1988 | Drews | 219/763 |
| 4,818,832 | 4/1989 | Fukumoto | 219/763 |
| 5,223,685 | 6/1993 | DeRienzo, Jr. | 219/10.55 |

*Primary Examiner*—Philip H. Leung
*Attorney, Agent, or Firm*—Mueller and Smith, LPA

[57] ABSTRACT

A freestanding shelving unit for supporting a first and second foodstuff within a microwave oven having an internal oven compartment with a support surface. The unit includes a generally planar, lower base member and a generally planar, upper platform member. The base member has a top surface for receiving the first foodstuff, a bottom surface receivable on the support surface of the oven compartment, and an outer periphery defining a proximal and a distal edge. The upper platform member has a top surface for receiving the second foodstuff, a bottom surface, and an outer periphery defining a proximal and a distal edge. A yoking portion is provided to extend from a first end supported at the proximal edge of the base member to a second end supporting the upper platform member at its proximal edge a spaced-apart distance from the base member. The upper platform member extends freely from the yoking portion at least partially over the base member.

5 Claims, 2 Drawing Sheets

MICROWAVE OVEN SHELF HAVING MULTIPLE FOOD SUPPORTING SURFACE

BACKGROUND OF THE INVENTION

The present invention relates generally to a freestanding shelving unit for use within a microwave oven which increases the usable space of the oven compartment thereof.

With time demands on the modern public ever increasing, the microwave oven has grown from a mere convenience to an outright necessity. The appeal of the microwave oven, principally, is the speed at which it heats and cooks certain foods with a relatively minimal amount of power consumption. However, certain problems heretofore have confronted microwave users.

One problem associated with the microwave oven has been its observed tendency to exhibit an uneven distribution of microwave energy throughout the cooking chamber as manifested by an uneven heating of the food being cooked. In response, turntables, either portable or built-in have been employed to rotate the food within the oven compartment and thereby provide for a more uniform heating profile. For example, representative portable turntables for microwave oven use are shown in Jorgensen et al., U.S. Pat. Nos. 4,258,630; 4,456,805; 4,504,715; and 4,523,070. An oven having a built-in turntable is shown in Shin, U.S. Pat. No. 4,036,151. Generally, both types of turntables have been found to be somewhat effective in mitigating hot-spots developed during microwave heating or cooking processes.

Although the problem of uneven heating, to a large extent, has been successfully addressed by the use of the aforesaid turntables and by changes in the design of the oven itself to effect a more uniform microwave distribution, other problems have continued to confront the microwave user. In particular, most microwave ovens designed for home use are provided as having, as compared to conventional electric or convection ranges, a relatively small oven compartment which generally measures about 1 cubic foot. Complicating this inherently small capacity, is that most microwave ovens are not provided with shelves as are found in conventional ranges. Thus, only the floor of the oven compartment typically is utilized as cooking space, which limits the cookware which may be heated during any one cooking cycle.

Especially frustrating is that microwave ovens commonly are used to reheat "leftovers" and the like directly in a serving dish such as a standard dinner plate. The confines of most ovens, however, are limited to an extent that only one such plate may be received on the floor of the oven compartment. When reheating a meal for two, or when reheating more than one such plate, the plates must be separately heated notwithstanding that the oven may have a sufficiently high power output capable of heating both simultaneously. As the second plated is being heated, the first plate is cooling and itself may have to be again reheated if both are to be served together. In any event, the need to separately heat both plates effectively doubles the overall cooking time for the meal.

Proposals have been made to increase the usable space within microwave oven compartments. In this regard, Hansen, U.S. Pat. No. 4,249,464, describes a meal rack for a microwave oven. The rack includes a frame formed as a rectangular grid, and a plurality of legs for elevating the frame above the floor of the oven. Colato et al., U.S. Pat. No. 4,539,455, describe an adjustable shelf for use in microwave ovens. The shelf includes a horizontally extending platform and a plurality of legs which may be moved into different positions to support the platform at various heights above the floor of the oven. DeRienzo, Jr., U.S. Pat. No. 5,223,685, describes a cooking platform for a microwave oven having a horizontal base with cooking and bottom surfaces, and a plurality of legs supporting the base in a horizontal position on the bottom wall of the oven. Colato, U.S. Pat. Nos. 4,713,513 and 4,593,171, describes shelf structures for use with a turntable in a microwave oven. The structures include a food-supporting platform and a base which rests on the table of the turntable. The base is formed of a plurality of legs which are peripherally-spaced about the platform.

The oven racks heretofore known in the art, however, generally are formed as having an upper shelf from which depends a plurality of legs for supporting the upper shelf on a lower shelf or on the floor of the oven compartment. The presence of the noted legs considerably limits both the access to the lower shelf and the usable space thereon such that the capacity of the oven compartment still is not maximized. Although, in some racks, the spacing of the legs to the diametric extents of the floor of the oven compartment does result in an increase in the usable area between the legs, such racks generally are not receivable on the table of most conventional turntables.

In view of the foregoing, it will be appreciated that improvements in racks and shelves for microwave ovens continue to be desired. Such improvements, if effected economically, would be well-received by consumers and would represent an important advancement in the art of microwave cooking.

BROAD STATEMENT OF THE INVENTION

The present invention is directed to a freestanding shelving unit for supporting a first and second foodstuff within the oven compartment of a microwave oven. Such unit provides for a lower base, a freely-extending upper platform, and a yoking portion which supports the platform member on the base. In so providing, the present invention allows for essentially unrestricted access to both the lower base and the upper platform while facilitating the utilization of the entire diametric extent of the oven compartment.

Still another aspect of the invention involves a method for heating a first and second foodstuff in a microwave oven having an internal oven compartment provided with a support surface. A freestanding shelving unit is disposed within the oven compartment. The unit includes a generally planar, lower base member formed of material substantially transparent to microwave energy and a generally planar, upper platform member formed of material substantially transparent to microwave energy. The base member has a top surface, a bottom surface received on the support surface of the oven compartment, and an outer periphery defining a proximal and a distal edge. The upper platform member has a top surface, a bottom surface, and an outer periphery defining a proximal and a distal edge. A single, generally upright yoking portion formed of material substantially transparent to microwave energy is provided to extend from a first end formed integrally with and supported at the proximal edge of the base member to a second end formed integrally with and supporting the upper platform member at its proximal edge a spaced-apart distance from the base member. The upper platform member extends freely from the yoking portion substantially coextensively over the base member the upper platform member being supported in moment arm fashion only by the yoking portion to define a substantially unrestricted space between the lower base member and the upper platform member. The first foodstuff is supported on the top surface of the base member, with the second foodstuff supported on the top surface of the upper platform member. Microwave energy then is introduced into the oven compartment to heat the first and second foodstuffs.

Yet another aspect of the invention involves a method for heating a first and second foodstuff in a microwave oven having an internal oven compartment provided with a support surface. A freestanding shelving unit is disposed within the oven compartment. The unit includes a housing member formed of material substantially transparent to microwave energy having a lower surface received on the support surface of the oven compartment, a generally planar, lower base member rotatably mounted on the housing member, and a generally planar, upper platform member formed of material substantially transparent to microwave energy. The base member has a top surface, a bottom surface, and an outer periphery defining a proximal and a distal edge. The upper platform member has a top surface, a bottom surface, and an outer periphery defining a proximal and a distal edge. A single, generally upright yoking portion formed of material substantially transparent to microwave energy is provided to extend from a first end supported at the proximal edge of the base member to a second end formed integrally with and supporting the upper platform member at its proximal edge a spaced-apart distance from the base member. The upper platform member extends freely from the yoking portion substantially coextensively over the base member the upper platform member being supported in moment art fashion only by the yoking portion to define substantially unrestricted space between the lower base member and the upper platform member. A drive motor is mounted to the housing member in a motion transmitting engagement with the base member. The first foodstuff is supported on the top surface of the base member, with the second foodstuff supported on the top surface of the upper platform member. The drive member then is actuated to rotate the base and upper platform members about a generally vertical axis, while microwave energy is introduced into the oven compartment to heat the first and second foodstuffs.

Advantages of the present invention include a shelving unit which increases the usable capacity of the oven compartment of a microwave oven by facilitating the utilization of the entire diametric extent of the compartment, and which allows for essentially unrestricted access to both a lower base and an upper platform member. Additional advantages include the provision of a shelving unit which is adapted to be received on both the floor of the oven compartment and on the rotatable table of a portable or built-in turntable, and which may be provided as having an integral turntable member. Further advantages include a shelving unit which may be economically manufactured from a plastic material having a high microwave transparency in a configuration which facilitates cleaning. These and other advantages will become readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

Figure 1:
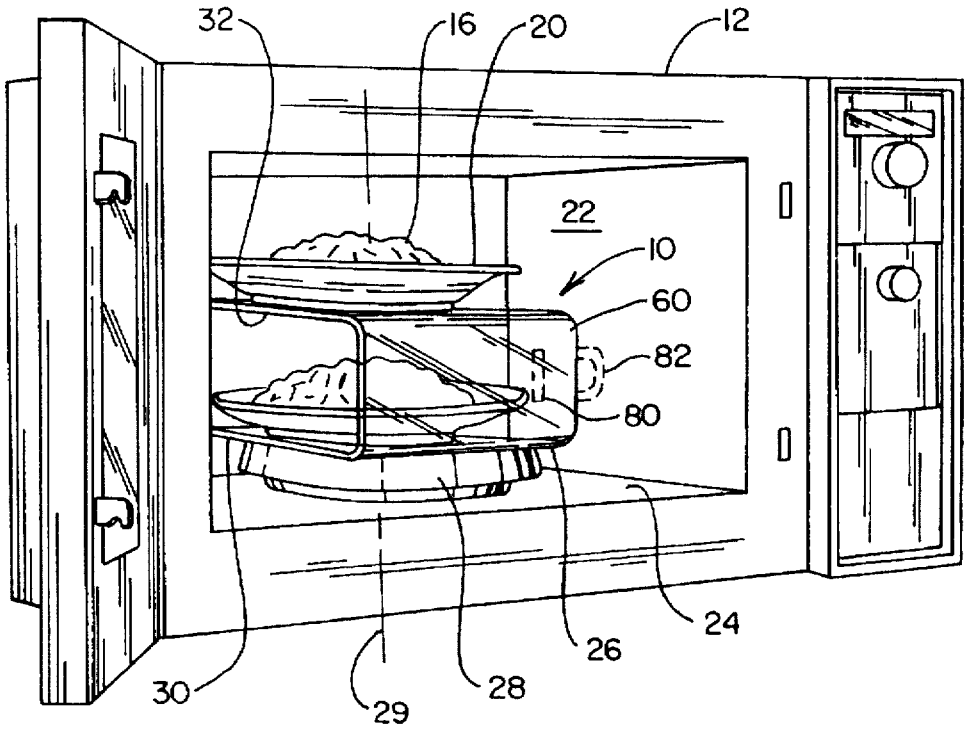
FIG. 1 is an isometric view of a shelving unit according to the present invention shown as disposed within the oven compartment of a microwave oven.

Referring to the figures wherein like parts are designated with like reference numerals, a freestanding shelving unit according to the present invention is shown generally in FIG. 1 at 10 as disposed within a microwave oven, 12. Shelving unit 10 supports at least a first and second foodstuff, 14 and 16, each having associated an associated plate, 18 and 20, or other microwave-safe ware or container. Microwave 12 is conventionally provided as having an integral oven compartment, represented at 22, into which is introduced electromagnetic energy in the microwave frequency band to effect the heating of foodstuffs 14 and 16 through the excitation of the water molecule dipoles therein. Oven compartment 22, which typically is of a rectangular configuration with a volumetric capacity of about 1 cubic foot, has a support surface which may be a bottom wall or floor, 24, thereof, or, as is shown, the rotating table, 26, of a carousel or turntable, 28. Although turntable 28 is represented for illustrative purposes as being of a portable variety, it will be appreciated that turntable 28 alternatively may be "built-in" or otherwise integral with oven compartment 22. Turntable 28 is provided to rotate unit 10 about the generally vertical axis represented at 29 and thereby provide for a more uniform exposure of foodstuffs 14 and 16 to the microwave energy.

Figure 2:
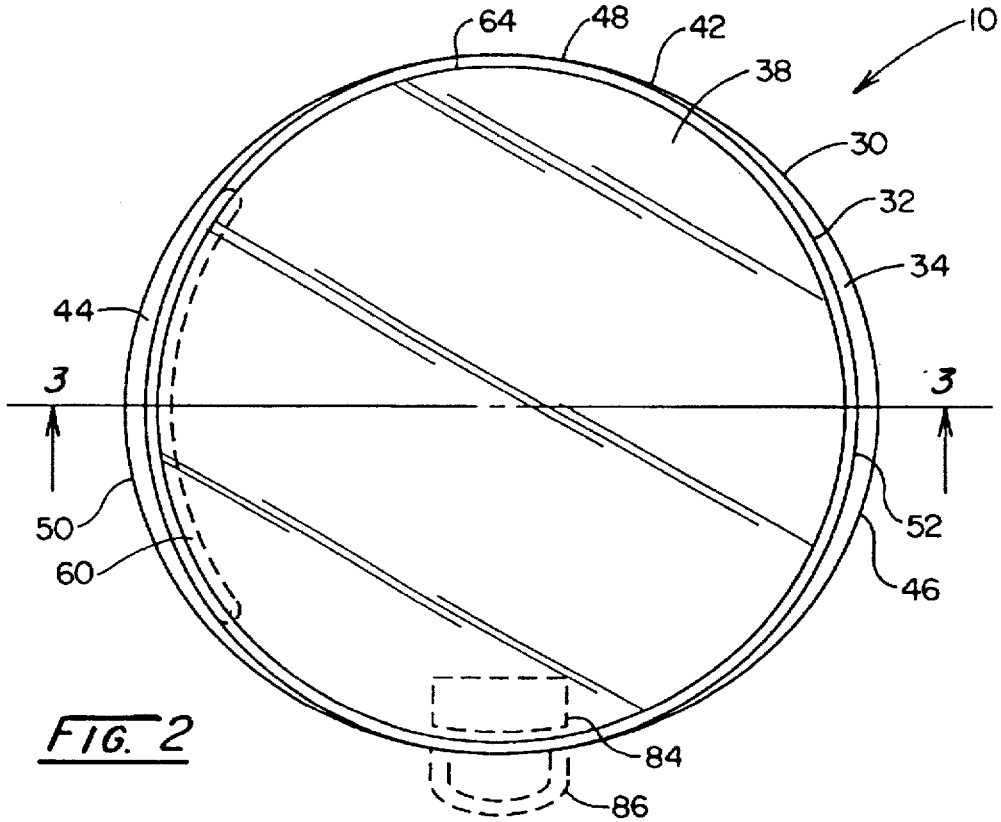
FIG. 2 is a top elevational view of a shelving unit according to the invention.
Figure 3:
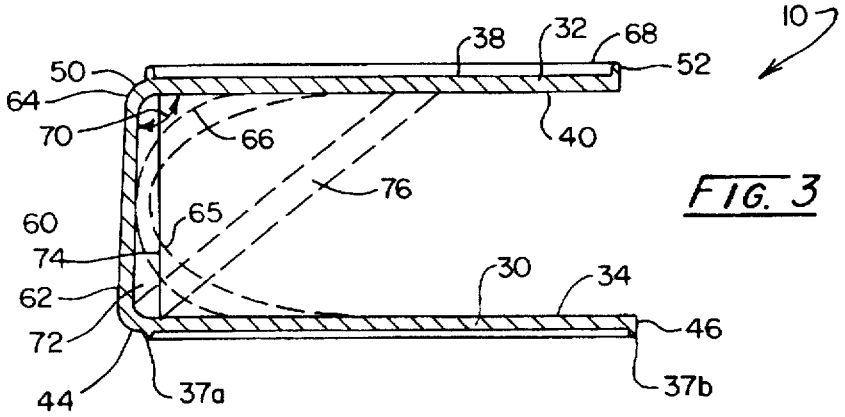
FIG. 3 is a cross-sectional view of the shelving unit of FIG. 1 taken through line 3-3- of FIG. 2.

Looking additionally to FIGS. 2 and 3, shelving unit 10 is shown as provided with a pair of generally planar shelving structures, namely, a lower base member, 30, and an upper platform member, 32. Base member 30 is formed as having a top surface, 34, for receiving first foodstuff 14, and a bottom surface, 36, received on the support surface 24 or 26 of oven compartment 22. Bottom surface 36 optionally may be provided with a pair of downwardly depending offsets, **37*a* and 37*b*, for elevating base member 30 a given distance off of the support surface. Upper platform member 32 is formed as having a top surface, 38, for receiving second foodstuff 16, and a bottom surface, 40. For retaining foodstuff 16 and associated plate 20 thereon, top surface 38** may be formed as being "dimpled" or otherwise textured effecting a coefficient of static friction providing an antiskid feature.

As may be best seen in FIG. 2, base member 30 extends to an outer periphery, 42, which is preferred to have a generally circular geometric configuration and which defines a proximal edge, 44, and a distal edge, 46. In like manner, upper platform member 32 extends to an outer periphery, 48, which also is preferred to be generally circular in geometric configuration and which defines a proximal edge 50 and a distal edge 52. It will be appreciated that peripheries 42 and 48 are configured such that unit 10 is receivable within oven compartment 22 (FIG. 1), and preferably as being circular to maximize the usable area of top surfaces 34 and 38, while minimizing any corners or other protuberances which might catch within oven compartment 22 as unit 10 is rotated on turntable 28 or the like.

Base and platform members 30 and 32 are illustrated as a matter of preference as being generally continuous surfaces which facilitate cleaning. However, such members alternatively may be provided as having an open or grid structure which may decrease material costs and improve the heat transfer characteristics of the shelving unit. Both configurations of members 30 and 32 therefore are to be considered within the precepts of the present invention.

For supporting upper platform member 32 on base member 30, a yoking portion, 60, is provided. As may be seen best with reference to FIG. 3, yoking portion 60 extends from a first end, 62, supported at the proximal edge 44 of base member 30, to a second end, 64, supporting upper platform member 32 at its proximal edge 50. The lengthwise extent of yoking portion 60 disposes upper platform member 32 a spaced-apart distance from base member 30 and the upper wall of oven compartment 22 (FIG. 1) such that foodstuffs 14 and 16, for example, are receivable therebetween. As is shown, yoking portion 60 preferably is integrally formed with base and upper platform members 30 and 32 to extend in a generally upright orientation therebetween. Such orientation of yoking portion 60 better conforms unit 10 to the confines of oven compartment 22. Alternatively, yoking portion 60 may be provided as a separate member, or as having the generally arcuate profile represented in phantom at 65 in FIG. 3.

It will be appreciated that the distal end 52 of upper platform member 32 is left unsupported such that the member is made to extend freely from yoking portion 60. The provision of yoking portion 60 therefore obviates the need for a plurality of leg members depending from upper platform member 32 for its support. Thus, the peripheries of base and upper platform members 30 and 32 may be configured as more fully utilizing the diametric extents of oven compartment 22 (FIG. 1), but as still allowing unit 10 to be receivable on the floor 24 thereof or on another support surface such as table 26 of turntable 28 (FIG. 1). The elimination of the plurality of leg members associated with the shelving designs heretofore known in art, moreover, provides for an essentially unrestricted access to the space intermediate members 30 and 32 thereby facilitating the supporting of foodstuffs or the like thereon.

As is shown in FIGS. 2 and 3, upper platform member 32 is disposed at least partially over base member 30 so as to define a moment arm therewith. Such moment arm stabilizes unit 10 making it less prone to tipping notwithstanding whether either or both of members 30 and 32 are loaded. To maximize the utilization of the volumetric capacity of oven compartment 22 (FIG. 1), however, it is preferred, as shown, that upper platform member 32 is provided to extend substantially coextensively with base member 30.

Depending upon the materials of construction selected for shelving unit 10, the described arrangement may develop a degree of flexion as between upper platform member 32 and yoking portion 60. Accordingly, and as is shown in FIG. 3, it additionally is preferred that unit 10 be constructed such that an oblique or obtuse angle, represented at 66, is formed as between the bottom surface 40 of upper platform member 32 and the lengthwise extent of yoking portion 60 to accommodate for any load flexion. When loaded, the upper surface 38 of upper platform member 32 thereby is provided to assume a generally parallel orientation with respect to the upper surface 34 of base member 30. Such an orientation assists in maintaining the load, such as foodstuff 16 and associated dish 20 (FIG. 1), on the top surface 38 of platform member 32. Unit 10 also may be constructed such that another obtuse angle is formed as between the upper surface 34 of base member 30 and the lengthwise extent of yoking portion 60. Further, and as is shown in FIGS. 2 and 3, at least a portion of the periphery 48 of upper platform member 32 optionally may be formed as a generally upstanding flange, 68, for additional load retention.

For further supporting upper platform member 32 on lower base member 30, stiffening ribs, as are shown in phantom at 70 and 72 in FIG. 3, may be provided to extend intermediate each of upper and lower members 32 and 30 and yoking portion 60. As also is shown in phantom, stiffening ribs optionally may be provided to extend vertically, 74, or, alternatively, diagonally, 76, with respect to yoking portion 60 intermediate members 32 and 30. Additionally, to decrease the degree of flexion as between members 32 and 30 and yoking portion 60, proximal edges 44 and 50 thereof and first and second ends 62 and 64 of yoking portion 60 may be formed as having an increased wall thickness. It will be appreciated that apart from making the structure of unit 10 more rigid, the stiffening ribs and selectively increased wall thicknesses afford the opportunity to construct members 30, 32, and 60 of a material having a generally decreased overall wall thickness for both weight and economic considerations.

As is shown in FIGS. 1 and 2 in phantom at 80, 82, and 84, one or more handles may be integrally formed into or provided to extend from upper platform member 32 and/or yoking portion 60. Such handles will be appreciated to conveniently provided handholds facilitating the carrying of unit 10.

Figure 4:
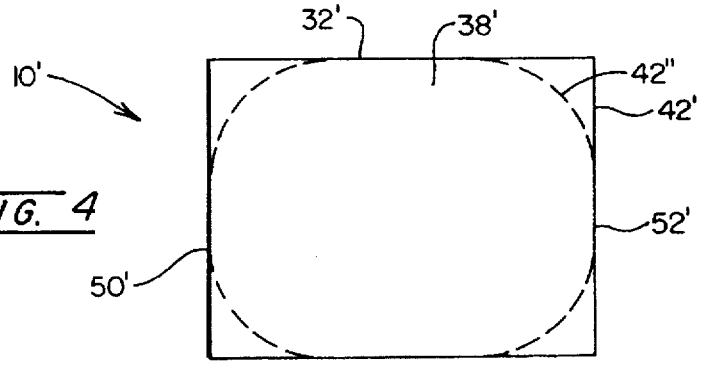
FIG. 4 is a top elevational view of an alternative embodiment of the shelving unit of FIG. 1 shown as having generally polygonal shelf peripheries.

Although shelving unit 10 has been described in the preceding as having a generally circular periphery as with respect to base member 30 and platform member 32, other geometric configurations may be envisioned and therefore are to be considered as being within the scope of the present invention herein involved. For example, and as is shown in FIG. 4 at 10' for upper platform member 32', unit 10 alternatively may be provided as having the generally polygonal periphery represented at 42' or the generally elliptical periphery represented in phantom at 42".

Figure 5:
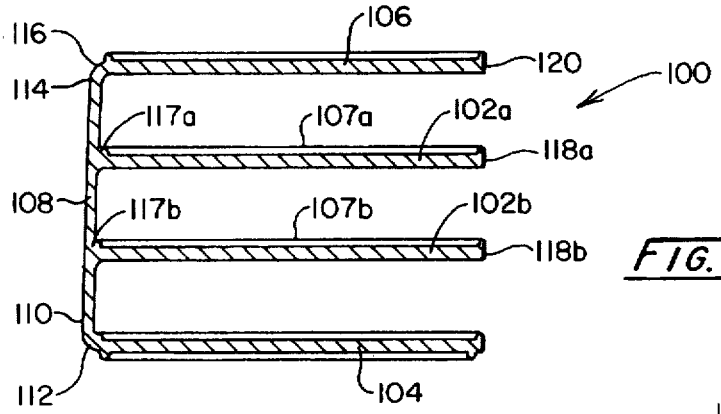
FIG. 5 is a side elevational view of an alternative embodiment of the shelving unit of FIG. 1 shown as having a plurality of shelving platforms.

Looking next to FIG. 5, an alternative embodiment of shelving unit 10 of the present invention is shown generally at 100 as having a pair of generally planar, intermediate platform members, **102*a* and 102*b*, each interposed a spaced-apart distance between a lower base member, 104, and an upper platform member, 106. Each of intermediate platform members 102 is provided with a top surface, 107*a* and 107*b*, for receiving an additional foodstuff or the like. Again, a yoking portion, 108, is provided to extend from a first end, 110, supported at a proximal edge, 112, of base member 104, to a second end, 114, supporting upper platform member 106 at a proximal edge, 116. Each of the proximal edges 117*a* and 117*b* of intermediate platform members 102*a* and 102*b* additionally is supported along yoking portion 108. As before, however, the distal ends 118*a*, 118*b*, and 120 of, respectively, platform members 102*a*, 102*b*, and 106 are left unsupported such that each of the platform members is made to extend freely from yoking portion 108 at least partially over base member 104. It will be appreciated that shelving unit 100** is suited for disposition in larger capacity ovens such as those commonly found in commercial or institutional settings.

Figure 6:
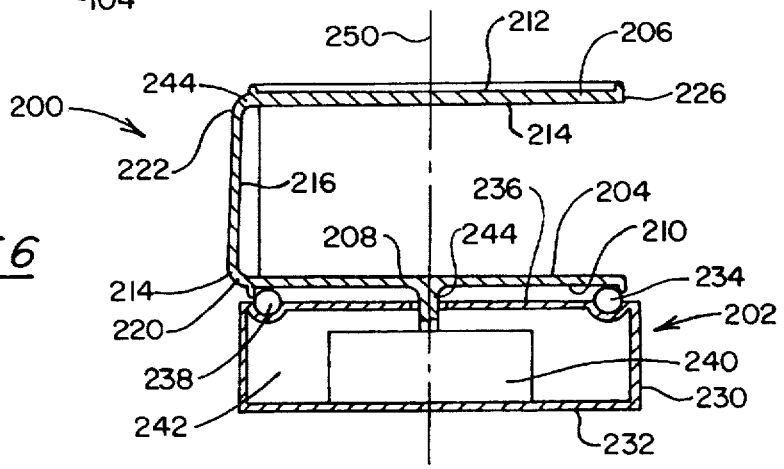
FIG. 6 is a side elevational view of an alternative embodiment of the shelving unit of the present invention shown as having an integrated turntable member.

Referring lastly to FIG. 6, another alternative embodiment of the shelving unit of the present invention is depicted at 200 as having a integral turntable member, shown generally at 202. Unit 200 includes a lower base member, 204, and an upper platform member, 206. Base member 204, accordingly, is formed as having a top surface, 208, for receiving a first foodstuff 14, and a bottom surface, 210. Upper platform member 206 likewise is formed as having a top surface, 212, for receiving a second foodstuff, and a bottom surface, 214. For supporting upper platform member 206 on base member 204, a yoking portion, 216, again is provided. Yoking portion 216 extends from a first end, 218, supported at the proximal edge 220 of base member 204, to a second end, 222, supporting upper platform member 206 at a proximal edge 224 a space-apart distance from base member 204. As before, however, the distal end 226 of platform member 206 is left unsupported such that the member is made to extend freely from yoking portion 216 at least partially over base member 204. The free extension of platform member 206 from yoking portion 216 facilitates access to the top surface 208 of base member 204 to more fully utilize the diametric extent of any oven compartment into which unit 200 is disposed.

Along with lower base member 204, turntable member 202 may be seen to additionally include a housing member, 230, having a lower surface, 232, which is receivable on a corresponding support surface of the oven compartment (not shown) into which unit 200 is disposed. Lower base member 204 is rotatably mounted on housing 230 via a number of bearings, one of which is shown at 234, interposed between bottom surface 210 of member 204 and an upper surface, 236, of housing 230. A drive motor, 240, is provided to be mounted to housing member 230 in a motion transmitting engagement with base member 204. As is shown, the bottom surface 210 of base member 204 defines an interior cavity, represented at 242, which receives drive motor 240. Alternatively, depending on design considerations, drive motor 240 may be mounted to the exterior of housing 230 in an arrangement in which the profile of turntable member 202 may be minimized. Drive power from drive motor 240 is supplied via a drive shaft, 244, which extends therefrom to lower base member 204. The actuation of drive motor 240 will be appreciated to effect the rotation of unit 200 about the generally vertical axis represented at 250.

As to the materials of construction for the shelving unit of the present invention, it is preferred that units 10, 100, and 200 thereof be substantially formed of a material having a low dielectric constant and dissipation factor, or which otherwise is relatively transparent to microwave energy at a thickness of about ¼-inch. Such a material is favored so as not to cause arcing within the oven compartment, or to otherwise interfere with the cooking or heating of the foodstuff. Suitable materials include thermoplastic or thermosetting polymeric materials, such as polyesters, polyethylenes, polypropylenes, polycarbonates, polystyrenes, polysulfones, acrylonitriles, butadiene styrenes, polyphenylene oxides, polyethylene terephthalates, acrylics, which materials additionally facilitate manufacture by relatively low-cost thermoforming, injection, or other molding processes. In this regard, the invention may be molded has having a generally one-piece construction, or as a plurality of parts which bonded adhesively or with fusion techniques, or otherwise joined with mechanical fasteners or in press-fit engagements. For direct cooking on the top surfaces of the base and platform members, the invention alternatively may be formed of a material or provided with an additive which is partially reflective of microwave energy, and which thereby effects a desired thermal browning of the foodstuff.

It is anticipated that certain changes may be made in the present invention without departing from the precepts herein involved. Accordingly, it is intended that all matter contained in the foregoing description shall be interpreted as illustrative and not in a limiting sense.

What is claimed is:

1. A method for heating a first and second foodstuff in a microwave oven having an internal oven compartment provided with a support surface, said method comprising the steps of:

(a) disposing within the oven compartment a freestanding shelving unit comprising:

a generally planar, lower base member formed of material substantially transparent to microwave energy having a top surface, a bottom surface received on the support surface of the oven compartment, and an outer periphery defining a proximal edge of given lengthwise extent and a distal edge;

a generally planar, upper platform member formed of material substantially transparent to microwave energy having a top surface a bottom surface, and an outer periphery defining a proximal edge of said given lengthwise extent and a distal edge; and a single, generally upstanding yoking portion formed of material substantially transparent to microwave energy, extending from a first end formed integrally with and supported at the proximal edge of said base member only along said given lengthwise extent to a second end formed integrally with and supporting said upper platform member at its proximal edge only along said given lengthwise extent a spaced-apart distance from said base member, said upper platform member extending freely outwardly from said yoking portion substantially coextensively over said base member, said upper platform member being supported in moment arm fashion only by said yoking portion to be stable while supporting said second foodstuff and to define a substantially unrestricted space between said lower base member and said upper platform member;

(b) supporting the first foodstuff on the top surface of the base member;

(c) supporting the second foodstuff on the top surface of the upper platform member; and (d) introducing microwave energy into the oven compartment to heat the first and second foodstuffs.

2. The method of claim 1 wherein said shelving unit is disposed within the oven compartment with the bottom surface of said upper platform member defining an obtuse angle with said yoking portion.

3. The method of claim 1 further comprising the step before step (d) of rotating the shelving unit within the oven compartment.

4. A method for heating a first and second foodstuff in a microwave oven having an internal oven compartment provided with a support surface, said method comprising the steps of:

(a) disposing within the oven compartment a freestanding shelving unit comprising:

a housing member having a lower surface received on the support surface of the oven compartment;

a generally planar, lower base member formed of material substantially transparent to microwave energy rotatably mounted on said housing member and having a top surface, a bottom surface, and an outer periphery defining a proximal edge of given lengthwise extent and a distal edge;

a generally planar, upper platform member formed of material substantially transparent to microwave energy having a top surface, a bottom surface, and an outer periphery defining a proximal edge of said given lengthwise extent and a distal edge;

a single, generally upstanding yoking portion formed of material substantially transparent to microwave energy, extending from a first end formed integrally with and supported at the proximal edge of said base member only along said given lengthwise extent to a second end formed integrally with and supporting said upper platform member at its proximal edge only along said given lengthwise extent a spaced-apart distance from said base member, said upper platform member extending freely outwardly from said yoking portion substantially coextensively over said base member, said upper platform member being supported in moment arm fashion only by said yoking portion to be stable while supporting said second foodstuff and to define a substantially unrestricted space between said lower base member and said upper platform member; and a drive motor mounted to said housing member in a motion transmitting engagement with said base member;

(b) supporting the first foodstuff on the top surface of the base member;

(c) supporting the second foodstuff on the top surface of the upper platform member;

(d) actuating said drive member to rotate said base member and said upper platform member about a generally vertical axis; and (e) introducing microwave energy into the oven compartment to heat the first and second foodstuffs.

5. The method of claim 4 wherein said shelving unit is disposed within the oven compartment with the bottom surface of said upper platform member defining an obtuse angle with said yoking portion.

* * * * *